United States Patent [19]

Landfors

[11] 4,373,868

[45] Feb. 15, 1983

[54] DIFFUSION PUMP FOR LEAK DETECTOR

[75] Inventor: Arthur A. Landfors, Newton, Mass.

[73] Assignee: Varian Associates, Inc., Palo Alto, Calif.

[21] Appl. No.: 870,234

[22] Filed: Jan. 17, 1978

Related U.S. Application Data

[63] Continuation-in-part of Ser. No. 702,654, Jul. 6, 1976, Pat. No. 4,140,438.

[51] Int. Cl.[3] ..... F04F 9/00

[52] U.S. Cl. ..... 417/154

[58] Field of Search ..... 73/40.7; 417/152-154

[56] References Cited

U.S. PATENT DOCUMENTS

| | | | |
|---|---|---|---|
| 1,791,105 | 2/1931 | Seitz | 417/153 X |
| 2,112,037 | 3/1938 | Malter | 417/154 |
| 2,150,676 | 3/1939 | Embree | 417/154 |
| 2,397,591 | 4/1946 | Becker | 417/154 |
| 2,437,849 | 3/1948 | Cox et al. | 417/154 |
| 2,438,387 | 3/1948 | Colaiaco | 417/154 |
| 2,447,636 | 8/1948 | Colaiaco et al. | 417/154 |
| 2,709,034 | 5/1955 | Lawrance et al. | 417/154 X |
| 3,686,474 | 8/1972 | Power | 417/154 |
| 3,690,151 | 9/1972 | Briggs | 73/40.7 |

*Primary Examiner*—Edward K. Look

*Attorney, Agent, or Firm*—Stanley Z. Cole; Allan M. Lowe; Edward H. Berkowitz

[57] ABSTRACT

A diffusion pump for a leak detector of helium or other light gases includes a foreline, responsive to gases from vacuum equipment being monitored for leak detection, and an inlet, connected to a mass spectrometer or other similar high vacuum gas measuring instrument. The diffusion pump includes two diffusion stages. The second stage has a diffuser throat with a relatively narrow width and small cross-sectional area so that the velocity of diffusion oil vapor flowing through it causes the light gases to be easily back diffused from the foreline to the inlet, while substantially preventing the flow of air or other relatively heavy gases between the foreline and the inlet. Fluid is returned to the pool by a conduit having a vertically extending, longitudinal axis aligned substantially with the center of the pool and an outlet orifice in proximity to the bottom of the pool, whereby the oil is returned to the coolest part of the pool at its bottom, central portion.

6 Claims, 2 Drawing Figures

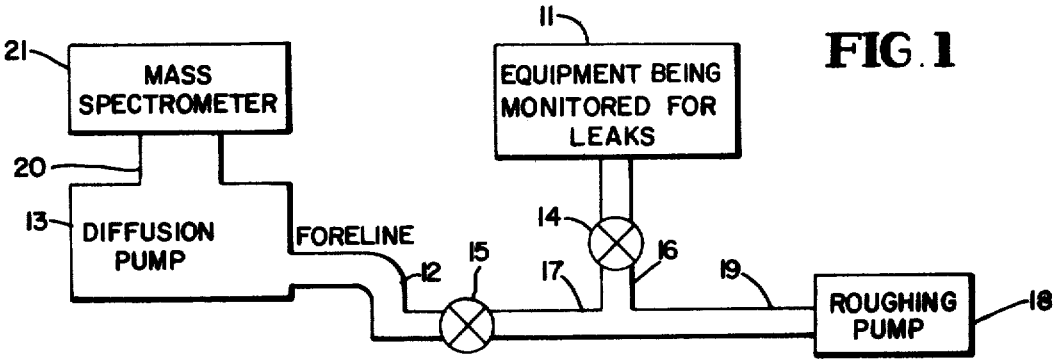
FIG. 1
FIG. 2
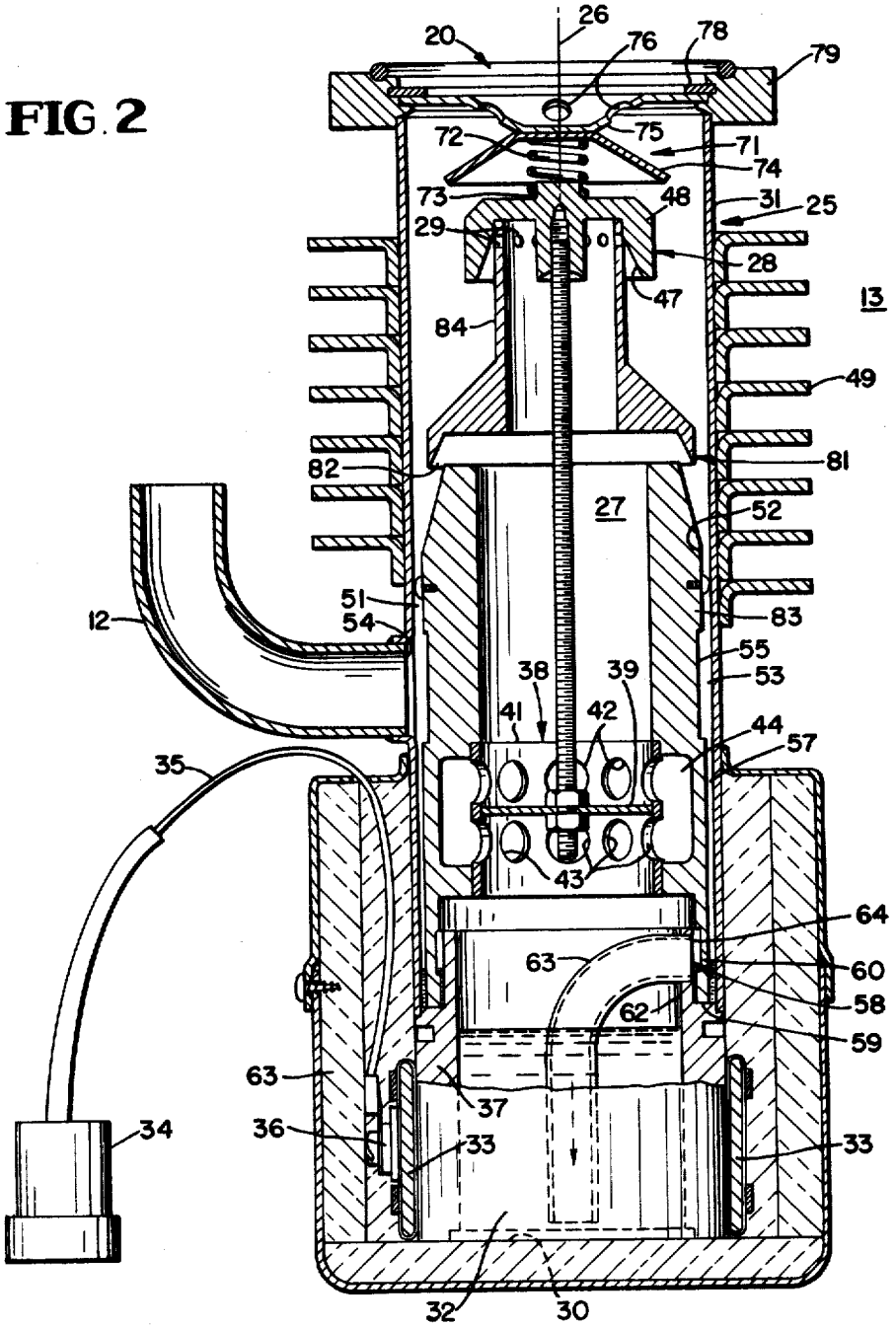

DIFFUSION PUMP FOR LEAK DETECTOR

RELATION TO CO-PENDING APPLICATION

The present application is a continuation-in-part and improvement of my co-pending, commonly assigned application, Ser. No. 702,654, entitled IMPROVED DIFFUSION PUMP, filed July 6, 1976 now U.S. Pat. No. 4,140,438.

FIELD OF THE INVENTION

The present invention relates generally to diffusion pumps, and more particularly, to a diffusion pump particularly adapted to be utilized as a filter for passing light gases, such as helium, between equipment being monitored for leaks and a gas analyzer, such as a mass spectrometer. In accordance with another aspect, the invention relates to a diffusion pump wherein condensed diffusion pump fluid is returned to a peripherally heated pool of the diffusion pump fluid, below the surface of the pool and in proximity to the bottom, central portion of the pool.

BACKGROUND OF THE INVENTION

In Briggs, U.S. Pat. No. 3,690,151, commonly assigned with the present invention, there is disclosed a method of and apparatus for detecting leaks of light gases, such as helium, from vacuum equipment wherein a high vacuum pump, such as a diffusion pump, is connected directly between the equipment and a gas monitoring instrument, such as a mass spectrometer. The equipment being monitored and the mass spectrometer are respectively connected to a foreline and an inlet of the diffusion pump. The diffusion pump effectively functions as a filter to enable a significant percentage of the light gas to flow from the equipment being monitored to the mass spectrometer, while virtually preventing the flow of heavy gases, such as water vapor and nitrogen in air, between the equipment and the mass spectrometer. Apparently, there is back diffusion of the light gases through vaporized jets of a diffusion pump fluid that is frequently an organic oil. The heavy gases, however, cannot back diffuse through the oil jet as easily. The mass spectrometer is responsive only to the light gas leaking from the equipment and relatively accurate indications of the amount of light gas leaking from the monitored equipment are obtained. Commercial equipment utilizing this principle has been extensively marketed under the trademark "Contraflow".

Diffusion pumps used in connection with leak detectors of the type disclosed by the Briggs patent ideally have a high tolerable forepressure for the heavy gases, while allowing the gas being detected to back diffuse quite readily from the foreline outlet of the diffusion pump to the diffusion pump inlet. As is well known, tolerable forepressure is the pressure at the diffusion pump foreline outlet which causes the vapor jet of the diffusion pump to collapse, allowing gas to pass almost freely from the foreline to the pump inlet. For virtually any foreline pressures less than the tolerable forepressure, the pressure at the inlet is maintained at a relatively constant, high vacuum, such as $10^{-6}$ torr. For foreline pressures greater than the tolerable forepressure, the inlet and foreline pressure are approximately equalized. Typical tolerable forepressures are on the order of 0.3 torr.

The tolerable forepressure of a diffusion pump is a direct function of the oil vapor density in an annular space or throat almost immediately downstream of a nozzle through which the oil vapor is diffused. If the cross-sectional area of the annular throat is reduced, less oil vapor is required to maintain the same oil density in the throat area. Decreasing the cross section of the throat, however, results in a decrease in pump speed. In diffusion pumps utilized in the normal operating mode, i.e., diffusion pumps that pump a load connected to the inlet to a high vacuum condition and which are not normally used in accordance with the teaching of the Briggs patent, the cross-sectional area of the throat is always an engineering compromise.

At foreline pressures lower than the tolerable forepressure and with the vapor jet fully formed, there is always a transfer of gas from the foreline to the pump inlet by a normal diffusion process. The amount of gas transferred from the foreline to the pump inlet is a function of the density of the oil vapor in the throat and the molecular weight of the gas flowing between the foreline and the pump inlet. The diffusion rate is lower for heavy gas molecules than for light gas molecules, which diffuse more quickly than heavy molecules.

The ratio of inlet pressure to the pressure at the foreline ($P_i/P_f$) for a given gas is so small in a well designed diffusion pump operating in the normal mode as to be of no practical significance. The inlet pressure ($P_i$) can only be measured with a very sensitive instrument. In the diffusion pump which has generally been employed with the Contraflow leak detector, enough helium may back diffuse between the foreline and the pump inlet so as to be measured with a mass spectrometer leak detector. Hence, the diffusion pump which has generally been employed in connection with the Contraflow leak detector performs two functions: (1) permits some back diffusion of the light gas (generally helium) from the foreline to the mass spectrometer while restricting the back diffusion of air from the foreline to the mass spectrometer; and (2) maintains a high vacuum in the mass spectrometer.

As noted supra, a diffusion pump of the type preferably employed in a Briggs type leak detector ideally has a high tolerable forepressure for air, but should allow helium to back diffuse quite readily. Unfortunately, a high tolerable forepressure for air requires a high vapor density, while a high rate of back diffusion for light gases requires a low vapor density.

In the diffusion pump generally employed in the present commercial, Contraflow leak detector, the amount and density of the vapor supplied to the nozzle is increased or decreased by varying the amount of energy supplied to a heater for a pool of the diffusion pump fluid in order to change the ratio $P_i/P_f$. A decrease in power results in an increase in the ratio $P_i/P_f$. More helium diffuses back through the pump but unfortunately the tolerable forepressure decreases.

BRIEF DESCRIPTION OF THE INVENTION

I have discovered that the ratio $P_i/P_f$ is not strictly a function of vapor density in the throat downstream of the last diffuser stage. Instead, I have found that the ratio is actually a function of both vapor density and the width of the annular diffuser throat, and that the ratio can be increased substantially without any sacrifice in tolerable forepressure by decreasing the width of the throat.

The inlet pressure of the diffusion pump may be expressed as:

$$P_i - P_f(D/S), \quad (1)$$

where:

D = back diffusion rate of helium or the light gas being detected, and

S = pump speed.

For maximum back diffusion of the light gas, and therefore maximum sensitivity of the mass spectrometer measurement, $P_i$ should be as high as possible. It was indicated supra that the tolerable forepressure could be maintained with a lower amount of energy being supplied to the oil pool by reducing the width of the diffuser throat. Based on experiments I conducted with diffuser throats having large width, it initially seemed that if the width of the throat were reduced, the ratio D/S would be unchanged. By experimentation I have unexpectedly discovered that the ratio D/S actually increases if the width of the throat is materially decreased.

The reason for this apparent anomaly is at present unknown, but the following hypothesis is offered. From Jaeckel's equation:

$$S = \frac{\overline{C}A}{4 + \frac{\overline{C}}{\Omega}} \quad (2)$$

where:

A = admittance area for gas molecules flowing into the vapor beam of the nozzle, i.e., A = pump cross-sectional area-nozzle cross-sectional area;

$\overline{C}$ = average molecular velocity of the gas being pumped; and $\Omega$ = velocity of the vapor stream flowing through the diffuser throat.

As the width of the diffuser throat is reduced, the vapor stream velocity is reduced because slow moving boundary layers comprise most of the cross section of the annular vapor stream. The quantity $\overline{C}/\Omega$ therefore increases sharply as the cross-sectional area is greatly reduced, and the pump speed, S, consequently is reduced. Therefore, from Equation (1), inlet pressure $P_i$ is increased.

The pump generally used in the prior art in connection with the Briggs type leak detector is a Varian Associates diffusion pump type HSA-150, Type 159. The HSA-150, Type 159 is a 3-stage diffusion pump, including three diffusion stages with no ejector stage. Fortuitously, the last diffusion stage has a relatively narrow throat, defined by an annulus having inner and outer diameters of approximately 1.88 and 2.12 inches, respectively, i.e., a width of approximately 0.12 inches. While the diffusion pump which has been generally employed in connection with leak detectors in accordance with the Briggs patent has functioned satisfactorily, it is to be understood that these pumps were not specifically designed for operation with leak detection devices that operate as taught by the Briggs patent, and that, therefore, the prior art diffusion pumps have been far from optimum.

In accordance with the present invention, the last stage throat of a diffusion pump has a relatively narrow annular width so that it permits the back diffusion of helium from the foreline to the space below the previous stage and then to the mass spectrometer connected to the pump inlet, while restricting the back diffusion of heavy gases, such as air. The previous stage is very weak and helium back diffuses readily through it. In a preferred embodiment, the pump has two stages, but it is to be understood that more stages can be included or that a single stage pump can be employed.

The diffusion pump has also been designed so that there is a high vacuum at the pump inlet. The relatively small width of the last stage diffuser does not make the pump efficient for gas handling capacity. However, devices operating in accordance with the teachings of the Briggs patent do not require a large gas handling capacity, but transparency to helium, maintaining a high vacuum in the mass spectrometer, and blocking heavy gases, are the desirable characteristics. In one particular embodiment, the annular throat has inner and outer diameters of approximately 2.18 and 2.32 inches, i.e., a width of 0.070 inches.

Immediately downstream of the narrow throat is a high fluid conductance region, positioned in alignment with an orifice which is connected to the foreline. In the preferred embodiment, the high conductance region is formed as an annulus having inner and outer radii of 1.0625 and 1.156 inches, respectively, i.e., an area of approximately 0.884 $in^2$. Without the relatively high conductance region, it is likely that the flow path between the foreline and the diffuser throat will have a variable conductance that could cause instability or blockage. This is because the condensed pump fluid adheres as a film to the exterior wall of the diffuser throat. At the orifice between the foreline and the pump body, a very narrow diffuser throat width is likely to result in a variable pressure around different cross-sectional portions of the throat so that there are significant variations in the flow impedance between the foreline orifice and the diffuser throat.

In accordance with a further aspect of the invention, an improved geometry is provided for the oil pool and a novel structure is provided for returning the condensed diffusion pump fluid to the pool. In my previously mentioned, co-pending application, the oil is maintained in a pool having a dome shaped floor. The dome apex extends above the surface of the pool and condensed oil flows onto the apex from an outlet at the bottom of a tube. The outlet is centrally located relative to and slightly above the dome. The pool is heated about its periphery so that there is a substantially unidirectional convection flow of the condensed oil through the pool from the central region toward the exterior heated wall of the pool.

In the pump of the present invention, the volume of the peripherally heated pool is substantially increased by eliminating the dome. The unidirectional, convection flow of condensed oil in the pool is attained by supplying the condensed fluid to the coolest part of the pool, in the center of the pool, below the surface and close to the bottom of the pool. To this end, a return tube includes an orifice that is submerged in, and close to the bottom of, the pool; the orifice is centrally located relative to the pool periphery.

It is, accordingly, an object of the present invention to provide a new and improved diffusion pump.

Another object of the invention is to provide a diffusion pump that is particularly adapted to be utilized in a leak detection system and method of the type disclosed in the aforementioned Briggs patent.

A further object of the invention is to provide a new and improved diffusion pump having a geometry that enables light gases, such as helium, to be easily back diffused from a foreline to a pump inlet, and which substantially prevents heavy gases, such as water and nitrogen, from flowing between the foreline and pump inlet.

An additional object of the invention is to provide a diffusion pump having an annular throat with a relatively small cross section to enable light gases to be easily back diffused and to substantially prevent the back diffusion of heavier gases, and wherein stable operation is attained despite the existence of the small cross-sectional throat.

Yet a further object of the invention is to provide a new and improved heater geometry for a diffusion pump.

A further object of the invention is to provide a new and improved diffusion pump having a peripheral heater for a pool of diffusion pump oil, wherein the volume of the oil in the pool is increased.

A further object of the invention is to provide a new and improved diffusion pump heater geometry which enables condensed diffusion pump oil to be returned to the coolest portion of a peripherally heated pool of the oil.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWING

FIG. 1 is a schematic diagram of a leak detector of the type disclosed by the Briggs patent; and FIG. 2 is a cross-sectional view of a preferred embodiment of the diffusion pump of the present invention which is particularly adapted to be utilized in the apparatus of FIG. 1.

DETAILED DESCRIPTION OF THE DRAWING

Reference is now made to FIG. 1 of the drawing wherein equipment 11 being monitored for leaks is selectively connected to foreline 12 of diffusion pump 13 via series connected valves 14 and 15 as well as lines or conduits 16 and 17. During idling, diffusion pump 13 is kept evacuated through valve 15 by roughing pump 18. To test, valve 15 is closed, valve 14 is opened, and equipment 11 is evacuated by roughing pump 18 through lines 16 and 19. Valve 15 is opened when pressure in equipment 11 has been reduced to 100 microns so that some light gas, e.g., He, flows from equipment 11 through valve 14, lines 16 and 17, and valve 15 to foreline 12. The light gas is back diffused by pump 13 from foreline 12 to inlet 20 of pump 13. The back diffused gas flows through inlet 20 to mass spectrometer 21. Spectrometer 21 measures the quantity of the light gas flowing to it through inlet 20 thereby to provide an indication of the leak characteristics of equipment 11. Heavy gases in equipment 11 that flow from the equipment into foreline 12 are prevented from reaching inlet 20 and mass spectrometer 21 by diffusion pump 13 so that they do not mask the effects of the light gas flowing into the mass spectrometer.

In accordance with the present invention, an improved diffusion pump 13, particularly adapted for the method and apparatus of FIG. 1, is provided. The improved diffusion pump, illustrated in FIG. 2, includes a cylindrical body assembly 25 having a longitudinal, centrally located axis 26. Concentric with axis 26 is a jet assembly 27 including two diffusion nozzle stages 28 and 81 that direct a beam of oil vapor against condensing wall 31. Diffuser nozzle stages 28 and 81 respectively diffuse annular jets of vaporized diffusion pump fluid, i.e., oil, through apertures 29 and 82 against the cylindrical wall 31 of body 25. It is to be understood that apertures 82 are formed between supporting posts (not shown) that project above jet base 83.

The vapor that flows through apertures 29 and 82 is evaporated from a liquid pool 32 of diffusion pump oil at the bottom of body 25. Pool 32 is heated by electric, resistance heater 33 that surrounds the periphery of the pool and which is electrically energized by a suitable source of current supplied to connector 32, lead 35 and contact 36 of the heater to form a boiler for the liquid oil in the pool. Heat energy from heater 33 flows through cylindrical, metal annular wall 37 that is coaxial with axis 26; the inner diameter of wall 37 defines the periphery of pool 32. To retain the heat energy of heater 33, pool wall 37 and floor 30 are surrounded by a suitable thermal insulating blanket 63.

The vaporized oil molecules flow upwardly to nozzles 28 and 81 from the surface of pool 32 through the interior of jet assembly 27. In the interior of jet assembly 27 is a baffle 38 that provides a tortuous path that separates liquid from vapor and allows the liquid to flow back into the boiler. Baffle 38 includes a horizontally extending plate 39, at right angles to axis 26, and a ring 41 that is set in grooves in the interior of jet assembly 27. Ring 41 includes two sets of apertures 42 and 43, respectively above and below plate 39. Vaporized oil flows out of apertures 43 into cylindrical gap 44 of jet assembly 27. From gap 44, the vaporized oil flows back into the interior of jet assembly 27 through apertures 42. Gap 44 has a circular cross section and a vertical extent approximately from the bottom of apertures 43 to the top of apertures 42.

The beam of oil vapor streams from apertures 29 between chimney 84 and wall 31 is relatively weak. Although stage 28 pumps gas rapidly in the direction of foreline 12, helium gas back diffuses through it quite readily. The beam of oil vapor streaming from apertures on throat 82 of last stage 81 on the other hand, is dense. It is directed into the narrow annular diffuser throat 51. Throat 51 is dimensional so that light gases, such as helium, which flow into foreline 12 are easily back-diffused through it to pump inlet 20, but heavy atmospheric gases such as water and nitrogen, are virtually entirely blocked in the throat and do not flow from foreline 12 to pump inlet 20.

To these ends, throat 51 has a width or gap between the inner and outer radii of the throat, i.e., between wall segment 52 and wall 31 of 1/16 inch. The inner and outer radii of the gap, as defined by the radii of wall segment 52 and the interior of wall 31, are respectively 1.094 in. and 1.156 in. The resulting cross-sectional area of throat 51 is thereby 0.422 $in^2$. It has been found that these dimensions, which are considerably smaller than the dimensions of a typical diffusion pump, and which prevent high capacity pumping, enable the pump of the present invention to function effectively to pass light gases from foreline 12 to inlet 20, while preventing the flow of heavy gases from the foreline to the inlet. Of course, throat 51 must have a length sufficiently long to provide the desired results of passing light gases and blocking the flow of heavy gases. In one particular embodiment, a length of ⅝ inch was found appropriate; it is to be understood, however, that the length of throat 51 is not particularly critical, but that the critical dimension is the width of the gap between wall segment 52 and wall 31.

Immediately downstream of and below throat 51 is relatively high fluid conductance region 53. Region 53 is substantially, horizontally aligned with circular aperture 54 in wall 31. Foreline 12 is connected to the interior of pump body 13 through aperture 54 so that a relatively high fluid conductivity path exists between the bottom of throat 51 and an orifice to foreline 12, and the connection between foreline 12 and pump 13. High conductivity region 53 is defined by the gap between stepped wall segment 55 of jet assembly 27 and the horizontally aligned interior portion of wall 31, except for the region opposite from aperture 54. Stepped wall segment 55 has a radius of 1.0625 in. so that the high fluid conductance region has an area of 0.884 $in^2$, if wall 31 is considered as the boundary of the high conductance region. High fluid conductance region 53 prevents condensed oil vapor from damming in region 52 and in the aperture of foreline 12 with body 25. In addition, the high conductance region prevents the light gas from being choked in aperture 54.

It is to be noted that diffusion pump 13 includes a single diffusion stage and that there is no ejector stage. This is because there is an imperforate wall segment of jet assembly 27 in the vicinity of aperture 54, whereby no vaporized diffusion oil can be radially ejected from the interior of the jet assembly into foreline 12.

The condensed oil, after flowing downwardly past region 53 flows back to pool 32 by an apparatus somewhat similar to that disclosed in the aforementioned co-pending application. In particular, the oil, in liquid form, flows through an annular region 57, having approximately the same cross-sectional dimensions as throat 51, to reservoir 58. Reservoir 58 is formed in an annular space extending above shelf 59 of the annular, metal cylinder that forms the peripheral wall for pool 32. The bottom edge of downwardly depending cylindrical skirt 60 of jet assembly 27 rests on shelf 59 and includes apertures (not shown) for enabling fluid to flow radially inward from an outer region of reservoir 58, between the skirt and wall 31, to an inner region of the reservoir, between the skirt and a relatively narrow, upwardly extending wall segment 62 of the cylinder forming the peripheral wall of pool 32.

Liquid in the inner region of reservoir 58 flows into pool 32 via return tube 63 that extends into the inner region of the reservoir through aperture 64 in wall 62. The liquid in reservoir 58 acts as a seal to prevent vapor acting against the upper surface of the inner region of the reservoir from causing bubbling in the outer region of the reservoir. It is noted that reservoir 58 is thermally isolated from peripheral, heating wall 38 of pool 32 so that the oil in the reservoir can not vaporize and the seal integrity is retained. The height of the liquid in the inner region of reservoir 58, determined by the height of tube 63 above shelf 59, is sufficient to form the seal. Tube 63 is located so that its outlet orifice is substantially on center line 26 and is below the surface of pool 32, in proximity to floor 30, whereby the liquid flows downwardly and radially inwardly from reservoir 58 through the tube to the coolest portion of the peripherally heated pool 21. The liquid flows in a unidirectional convection path radially outward and upward from the outlet orifice of tube 63 to the surface of pool 32, where it is heated sufficiently to become vaporized.

To prevent possible flow of vaporized oil from nozzle stage 28 through inlet 20 into mass spectrometer 21, baffle 71 urges spring 72 downwardly as a hold-down for jet assembly 27. Baffle 71 includes a pair of oppositely directed frustoconical segments 74 and 75 having bonded horizontally extending bases. Segment 74 is imperforate, while segment 75 includes several circular apertures 76 in its sidewall. The lower edge of segment 74 extends beyond the periphery of cap 48 to block any line of sight path for oil flowing from nozzle stage 28 to apertures 76. Segment 75 includes an upper, horizontally extending flange 77 that is held in situ by retaining ring, which in turn is held in situ by collar 79 on the exterior of body assembly 25.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A diffusion pump comprising a body assembly including a cool wall having a longitudinal, centrally located axis, a cylindrical heater for establishing a cylindrical radial thermal gradient, said heater comprising a heating wall coaxial with the body assembly and surrounding a pool of liquid that the heater causes to boil changing its state to vapor, a jet assembly coaxial with the body assembly, means for providing a flow path for the vapor from the surface of the pool to the jet assembly, the jet assembly inducing at least one annular nozzle concentric with the axis for directing the vapor downwardly against the cool wall, the cool wall condensing the vapor striking it into a liquid that flows downwardly along the body assembly toward the pool, and means for providing a flow path for the condensed liquid directly from the body assembly to a region substantially at the bottom of the pool and on the axis so that the condensed liquid flows outwardly and upwardly from the bottom of the pool and the axis.

2. The pump of claim 1 wherein the jet assembly is mounted above the heating wall for the pool to be substantially thermally isolated from the heating wall.

3. The pump of claim 1 wherein the jet assembly and body assembly are mounted on a shelf above the heating wall for the pool to form an annular reservoir for the downwardly flowing liquid, the reservoir being thermally isolated from the heating wall for the pool, the flow path providing means for the liquid including a return tube extending downwardly from the reservoir toward the on axis region for providing a flow path for overflow liquid in the reservoir, said return tube having an orifice submerged in the pool in proximity to the bottom of the pool, and on the axis.

4. The pump of claim 3 wherein the pool is located in a pool reservoir having a relatively flat bottom.

5. The pump of claim 1 wherein the pool is located in a pool reservoir having a relatively flat bottom.

6. The pump of claim 5 wherein the flow path providing means includes a return tube having an orifice submerged in the pool in proximity to the bottom of the pool, and on the axis.

* * * * *